United States Patent [19]

Barbour

[11] 4,393,768

[45] Jul. 19, 1983

[54] VARIABLE DATA IMPRINTER WITH RACK CENTERING AND CARRIAGE INTERLOCK MECHANISM

[75] Inventor: William P. Barbour, Mount Prospect, Ill.

[73] Assignee: Security Imprinter Corporation, Walkersville, Md.

[21] Appl. No.: 352,931

[22] Filed: Feb. 26, 1982

Related U.S. Application Data

[63] Continuation of Ser. No. 146,098, May 2, 1980, abandoned.

[51] Int. Cl.[3] ..... B41F 3/60

[52] U.S. Cl. ..... 101/45; 101/269

[58] Field of Search ..... 101/45, 56, 269–274

[56] References Cited

U.S. PATENT DOCUMENTS

| | | | |
|---|---|---|---|
| 3,138,091 | 6/1964 | Maul | 101/45 |
| 3,322,062 | 5/1967 | Maul | 101/45 |
| 3,405,634 | 10/1968 | Maul et al. | 101/45 |
| 3,739,716 | 6/1973 | Barbour | 101/45 |
| 3,818,826 | 6/1974 | Geiger | 101/45 |
| 3,826,190 | 7/1974 | Zofchak | 101/45 |
| 3,881,411 | 5/1975 | Araki et al. | 101/45 |
| 3,946,665 | 3/1976 | Valentine et al. | 101/45 |
| 3,983,802 | 10/1976 | Thomson et al. | 101/45 |

FOREIGN PATENT DOCUMENTS 964922 3/1975 Canada .

*Primary Examiner*—Edward M. Coven
*Attorney, Agent, or Firm*—Mason, Fenwick & Lawrence

[57] ABSTRACT

A varible data imprinting machine having an elongated flat printing bed section providing a document supporting surface and having a print wheel pack formed of closely adjacent peripherally notched print wheels, an imprinting carriage moveable through advance and return strokes longitudinally along the document support surface and an elongated rack section perpendicular to the printing bed section subadjacent the wheel pack having a number-indicating rack control panel projecting therefrom and including a plurality of toothed racks coarse manually adjusted longitudinally in the rack case to rotatably index the print wheels to number-printing positions. The rack case includes a pivoted centering blade activated by carriage movement to fine adjust the racks as the carriage leaves parked position and interlock means provided to latch the carriage at parked position following an imprinting cycle until one of the racks is readjusted.

10 Claims, 7 Drawing Figures

Fig-1
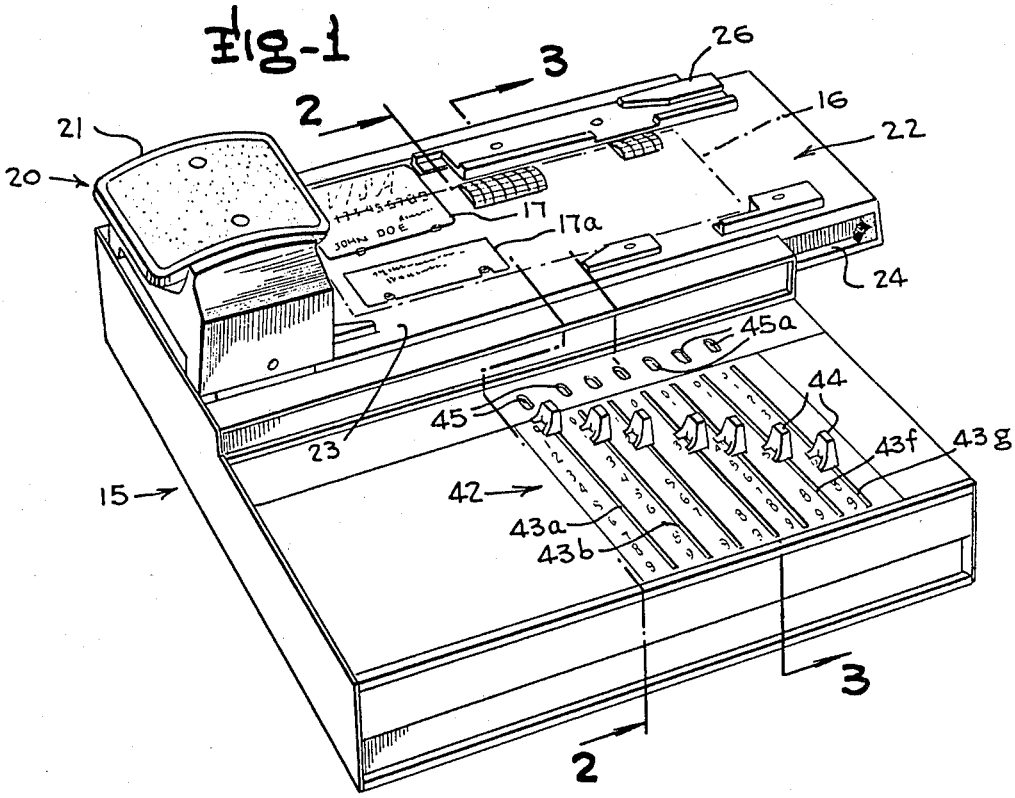
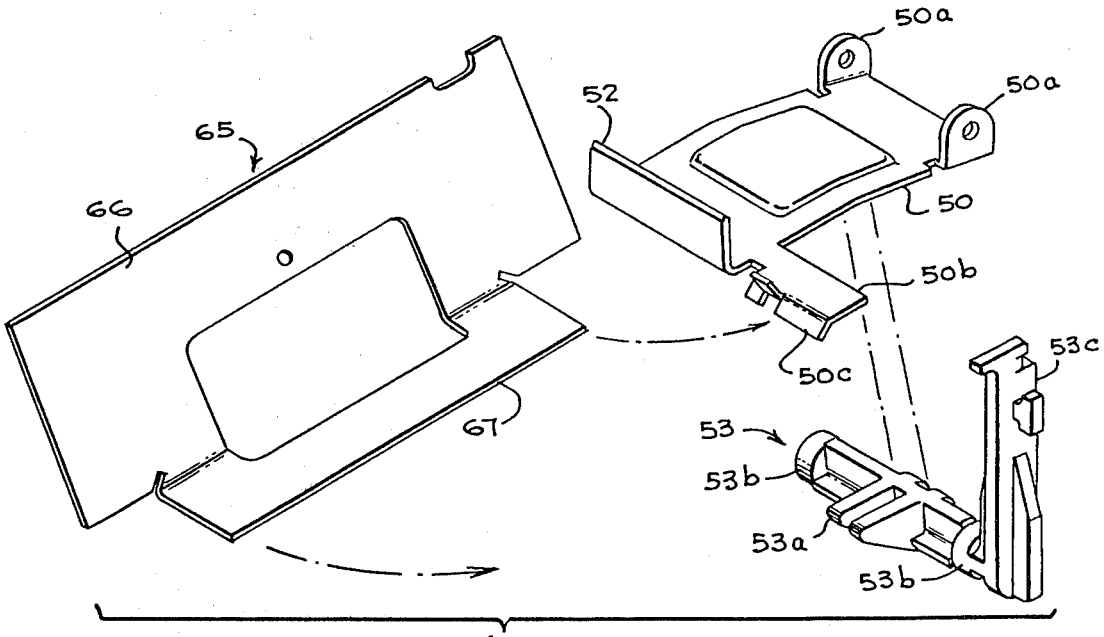
Fig-7

VARIABLE DATA IMPRINTER WITH RACK CENTERING AND CARRIAGE INTERLOCK MECHANISM

This is a continuation, of application Ser. No. 146,098, filed May 2, 1980, abandoned.

BACKGROUND AND OBJECTS OF THE INVENTION

The present invention relates in general to manually operated imprinting machines, and more particularly to manually operated imprinters of the type using a plurality of printing wheels each of which may be selectively indexed so as to be able to present a variety of indicia to a document, usually formed of one or more sheets, placed on an imprinting bed over the printing wheels.

Imprinting machines wherein a plurality of printing wheels may be manually indexed to present a variety of indicia to a sheet or plural sheet document or sales ticket, concurrently with imprinting on the document or sales ticket certain information embossed on a credit card or the like, have come into wide use for recording sales information in the petroleum industry, for example at gasoline service stations, and to some extent in the bank sponsored credit industry. Such imprinting machines, which are frequently referred to as imprinters, have been utilized to transfer embossed information from a plastic card as well as data relating to the particular sales transaction, such as date, price, etc., on a document usually formed of a plurality of sheets forming a sales ticket, so that one of the sheets of the plural sheet document may be subsequently relied upon as the record of the transaction and processed for purposes of billing the customer. The documents that are commonly used to record such transactions usually consist of a plurality of sheets containing one or more carbons to provide several copies of the transaction. Use of a rolling platen has been resorted to for carrying out the printing operation by pressing the plural document sheet positioned on an imprinting bed against the printing wheels and the credit card to obtain clear impressions on each copy. An example of such a variable data imprinting machine is disclosed in my earlier U.S. Pat. No. 3,738,716 granted June 19, 1973.

Presently available variable amount imprinters wherein the printing wheels are driven by mechanical means currently depend on precisely made steel racks, usually of stainless steel, which are held in precise proximity to the toothed portion of the print wheels by stampings, dye castings, steel shafts and the like. The racks area, of course, held in close proximity where they run under the closely spaced print wheels in driving relation to the toothed portion of the print wheels, and are arranged in such a way as to provide sufficient lateral spacing between the racks along a keyboard or control panel where an operator may grasp them without interference from the next adjacent rack terminus, usually a manipulating knob. Presently, this lateral spacing or "offsetting" of the racks in the keyboard or control panel zone relies on creating offset arms on the individual racks, or the spacing or offsetting may involve separate offsetting arms which may be attached to each rack by spot-welding or other mechanical means. Regardless of the means used to obtain this "offsetting" of the rack manipulated portions in the keyboard zone, a guidance and support system is present to have the racks run smoothly, which usually takes the form of plastic molded blocks, wheels, runners and the like.

While the racks are "coarse adjusted" by hand manipulation of upstanding end formations or knobs along the keyboard or control panel to number-setting positions indicated by control panel numbers, it is important to also provide mechanisms for "fine adjusting" the print wheels automatically to precisely centered printing positions before the rolling platen reaches the print wheels to ensure a proper imprint. Also, it is desirable to disable the rolling platen from executing a printing stroke following one printing cycle until at least one of the racks is reset to another position.

An object of the present invention is the provision of a novel variable data imprinting machine involving a plurality of closely spaced or packed print wheels projecting through an imprinter bedplate for imprinting number or character information on plural sheet documents such as sales tickets or the like supported on the bed, along with imprinting credit card information thereon, wherein the print wheels are indexed to coarse adjusted positions by racks manually adjustable from a keyboard or control panel area and means is activated during a portion of an imprinting cycle to precisely center or fine adjust the print wheels before imprinting.

Another object of the present invention is the provision of a novel variable data imprinting machine having a plurality of character bearing print wheels which are closely packed together and mechanically driven by a rack structure to position selected characters in upwardly facing printing position, and wherein a novel mechanism is provided to automatically accurately center the upwardly facing characters in a predetermined imprinting position during movement of a printing roller carriage from normal parked position through an imprinting stroke.

Another object of the present invention is the provision of a novel variable data imprinting machine as described in any of the preceding paragraphs, wherein there is provided a novel interlock mechanism designed to maintain the printing roller carrier restrained in parked position at the end of its return stroke after imprinting, until at least one of the racks for positioning the imprinting wheels has been readjusted, so that the carrier cannot be reciprocated through another printing stroke without readjustment of the racks.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 1 is a perspective view of a variable data imprinter constructed in accordance with the present invention;

FIG. 7 is an exploded perspective view of the bell crank, blade plate and blocking plate.

DETAILED DESCRIPTION OF A PREFERRED EMBODIMENT

Figure 2:
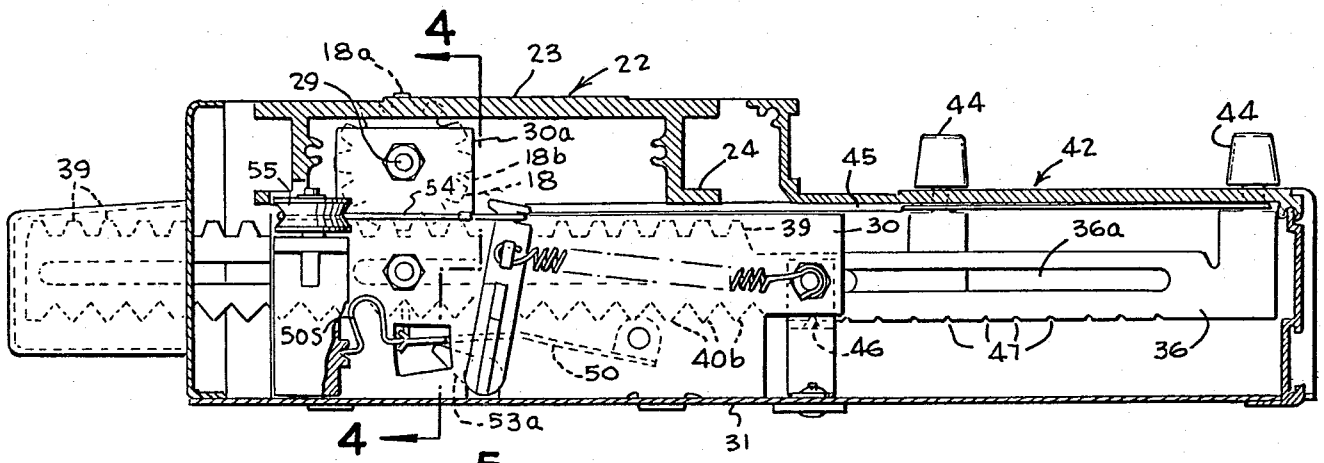
FIGS. 2 and 3 are vertical sectional views transverse to the carriage movement axis along the print bed, taken along lines 2—2 and 3—3 of FIG. 1.

Referring to the drawings, wherein like reference characters designate corresponding parts throughout the several figures, the imprinting machine of the present invention, indicated generally by the reference character 15, is designed, for example, for impressing indicia on a sales record document, indicated in broken lines at 16, such as a multiple sheet sales ticket or card-and-sheet preassembled sales record document with interleaved carbons providing sales transaction information such as amount of purchase, date of sales transaction, name and/or code number designation of the purchaser credit card holder, and perhaps the name and/or code number of the seller. The name and/or code number (or credit card number) of the purchaser are provided by embossings on the customer credit card, indicated at 17, and the corresponding identification information regarding the seller, if the latter is to be imprinted on the document, are provided by embossings on a seller identifying plate 17*a* or may be preprinted on the sales document. The other sales data such as amount of purchase is provided by a bank of amount print wheels 18, and optional date print wheels (not shown), of conventional known construction may be optionally included.

The imprinter 15 of the preferred example is of the variable data type currently in wide demand for imprinting sales information at gasoline service stations and the like, designed to permit the print wheels to be manually indexed for imprinting of numbers respresenting the amount of purchase on the sales ticket. To this end, the imprinter is of the roller platen type, constructed for example substantially in the manner disclosed in U.S. Pat. No. 3,538,848 or 3,954,056, so as to include a roller platen imprinter portion formed of a carriage 20 having a handle forming cover 21 shaped for comfort as a handgrip for use by the operator. The carriage 20 is adapted to be reciprocated through an advance stroke and a return stroke along the major portion of a printing bed 22. The printing bed 22 provides an upwardly facing flat bed surface 23 on which the customer credit card and the sales record document 16 are to be deposited, and the carriage 20 is designed to traverse the printing bed surface 23 through a rectilinear imprint stroke during its advance movement toward the right as viewed in FIG. 1 and then return to its rest position to the left as viewed in FIG. 1. Tracks are provided on each side of the printing bed 22, one of which is shown at 24, in which a pair of rollers 20*a* are located in each track and are journaled on depending side flanges of the carriage 20, all as disclosed in the above identified earlier patents. In the illustrated embodiment, stop shoulder members or rollers 24*a* of nylon, teflon or the like fixed on the carriage frame bear against the side rims of the printing bed above the rollers 20*a*.

Figure 3:
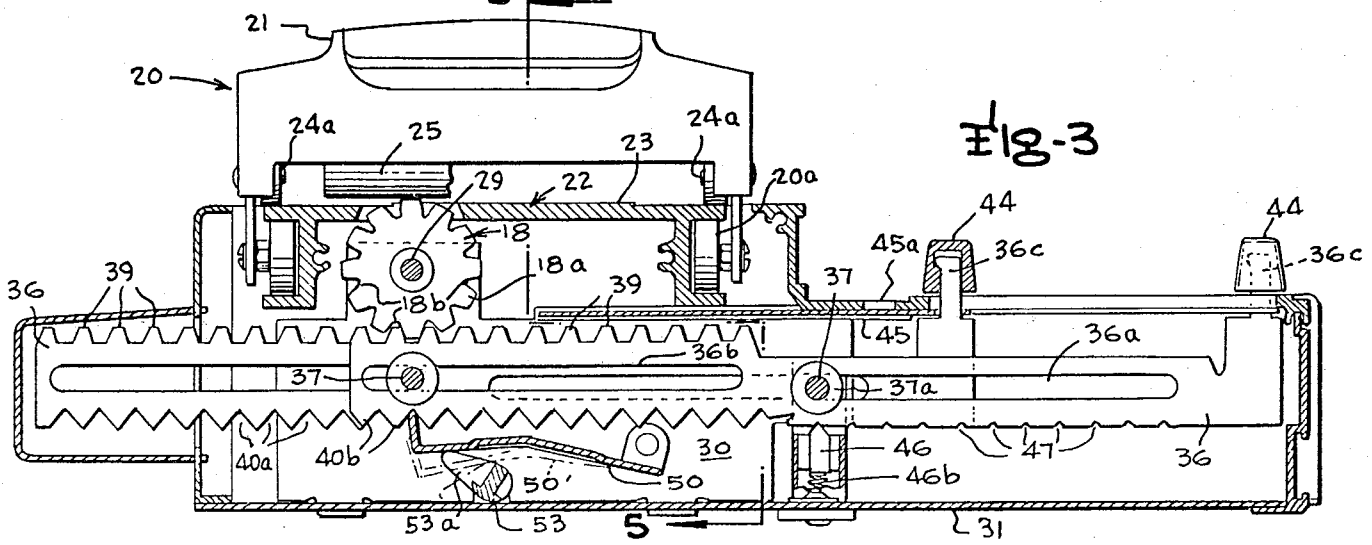

A hard cylindrical printing roller, part of which is shown at 25 in FIG. 3, is rotatably mounted on a shaft supported for rotation in the carriage 20 below the cover 21 and is carried in a manner providing for movement of the roller within the carriage between a lower imprinting position during the advance or printing stroke of the carriage 20 and a raised nonimprinting or inactive position during the return stroke of the carriage. To this end, a pair of inclined ramp formations, one of which is shown at 26, are provided near opposite ends of the printing bed surface 23, in the preferred embodiment, to engage projecting end portions of the shaft for the printing roller 25 and lift it to the raised position at the end of the advance or printing stroke, and return it to the lower position at the end of the return stroke, all as disclosed in earlier U.S. Pat. No. 3,954,056. The printing bed surface 23 in the illustrated embodiment is also provided with card locators to properly position the customer credit card 17 on the bed surface 23, and usually includes locators for the sales record document or ticket 16, in accordance with customary construction practices for printing machines.

The amount print wheels 18 in the illustrated embodiment are of conventional construction which in the illustrated embodiment form a bank of seven individual amount print wheels such as conventional 12 position print wheels having 12 circumferentially spaced imprint block portions 18*a* with raised type font on eleven of the block portions to imprint the characters 0 to 9 and a special symbol. These are separated from each other by twelve interposer notches 18*b* arranged to receive upwardly projecting teeth on adjusting rack members which are manually coarse adjusted and then are fine adjusted by an interposer blade member as later described for precisely positioning the print wheels to center the printing font at the correct position to be imprinted on the sales record document. The bank of seven amount print wheels 18 are mounted on a shaft 29 extending through spacers at opposite sides of the print wheel pack into openings in upwardly projecting mounting ears 30*a* of a pair of spaced side assembly plates 30 supported from the bottom wall 31 of a main frame chassis 32 for the printing bed 22. The main frame chassis 32 has a top flange at one end, indicated at 32*a*, which is the parked end for the carriage 20, and has a single apertured mounting ear 32*b* at the side of the printing wheel pack opposite the end 32*a*, providing a three point bolt, nut and elastomeric compression washer system, one of which is indicated at 34, whereby the printing bed surface is secured an adjustable distance from the chassis 32 by adjustment of the nut variably compressing the washer between the printing bed surface and the upper flange of the mounting ear 32*b* and a lock nut assembled on the bolt. By variably adjusting the nuts of the three mounting bolt and nut and compressor washer assemblies 34, the amount of projection of the print wheels 18 above the surface of the printing bed surface 23 can be adjusted to present their topmost character to the imprinter platen or printing bed surface 23 for imprinting.

Precisely made rigid metal racks 36 such as stainless steel racks, are held in precise proximity to the toothed portion of the print wheels 18 formed by the circumferentially spaced array of block portions 18*a* and interposer notches 18*b*, have elongated slots 36*a* and 36*b* occupying most of the rear and front halves of the racks to receive bolts 37 fixed in the side plates 30 for guiding the racks, and spacers 37*a* on the bolts 37 position them close together in the region of the bolts 37 and where they engage the printing wheels, while their ends 36*c* are bent to dispose them sufficiently far apart for noninterfering individual adjustment at the manually adjusted ends. The racks 36 have a plurality of teeth 39 along their upper edges conforming substantially to the shape of the interposer notches 18*b* in the amount print wheels 18 and a plurality of downwardly divergent V-shaped centering recesses or notches 40*a* along their lower edges arranged in series relation with triangular teeth 40*b* between the respective centering notches 40*a* for the purpose of achieving precise centering or printing position alignment of the topmost character on the respective printing wheels, after coarse manual adjustment thereof.

The number-indicating slide knob control panel 42 extending to the right of the imprinter printing bed 22 in FIG. 2 includes seven elongated slots 43*a* to 43*g* aligned vertically with the bent portions 36*c* of the racks 36, through which extend the bent upwardly projecting rack end portions 36*c* on which knob members 44 are fixed. The upwardly extending knob members 44 lie above the plane of the control panel 42 and are shaped to facilitate grasping and movement of the knobs and their associated racks. Numbers, for example on rigid slide strips 45, are fitted on the upwardly projecting rack end portions 35*c* and slide in guideways immediately below the surface of the panel 42 below a sight opening 45*a* through which the numbers may be viewed, to thereby indicate the appropriate positions to which the knobs should be adjusted to set the amount print wheels 18 to imprint the corresponding number on the sales record document. Detenting of the knobs is provided by a detent wedge 46, transversely underlying and spanning the set of racks 36 in the illustrated embodiment, and biased upwardly by a spring 46*b*, to interfit in downwardly facing notches indicated at 47 below the slots 36*a* in the racks 36.

It is desirable that the imprinter machine include a mechanism for accurately centering the troughs between the upper rack teeth 39 of the racks 39 in vertical alignment with the center axis of the amount print wheel shaft 29 during an early part of the advance or printing stroke of the carriage 20 or at least before the printing roller reaches the zone occupied by the amount print wheels, to insure proper registration of the upwardly facing characters on the print wheels with the imprinting area of the sales record document. This is because sight adjustment of the knobs 44 to the desired position by observing the numbers on the number strips 45, even with the aid of the spring detenting means, would not insure sufficiently precise registration of the amount wheel characters with the desired precision. Interrelated with this mechanism is an interlock mechanism designed to maintain the carrier 20 restrained in parked position at the end of the return stroke after imprinting until a rack has been readjusted, so that the carrier cannot be reciprocated through another printing and return stroke without readjustment of the knobs and racks.

The mechanism for effecting the centering of the amount printing wheels 18 and the interlocking of the carrier includes a centering blade plate 50, forming a lever having integral apertured pivot ears 50*a* adjacent one transverse edge of the plate 50 for receiving a pivot pin or rivet supported in apertures in the side assembly plates 30. The centering blade plate 50 has an upwardly extending centering blade formation 52 providing an upwardly projecting thin blade formation to interfit into one of the notches 40*a* of each rack 36 after they have been adjusted to desired number indicating positions and movement of the carrier 20 has commenced. The blade plate 50 and blade formation 52 normally occupy a lower position, indicated partially in broken lines at 50' in FIG. 3, resting against the arm 53*a* of bell crank member 53, which has trunnions or pivot stub shaft portions 53*b* also extending into trapping slots 30*s* in side assembly plates 30. The arm 53*a* of the bell crank 53 has a free-edge portion underlying the part of the blade plate 50 immediately adjacent the blade 52 which bears against the underside of the blade plate 50 and raises it to the upper rack centering position shown in solid lines in FIG. 3, when the bell crank 53 is pivoted to its solid line raised position. The bell crank includes an extension 53*c* projecting upwardly from the arm 53*a* outwardly along one side of one of the side assembly plates 30 a greater distance from the pivot axis of the bell crank to receive the end portion of a cable 54 anchored to it.

Figure 6:
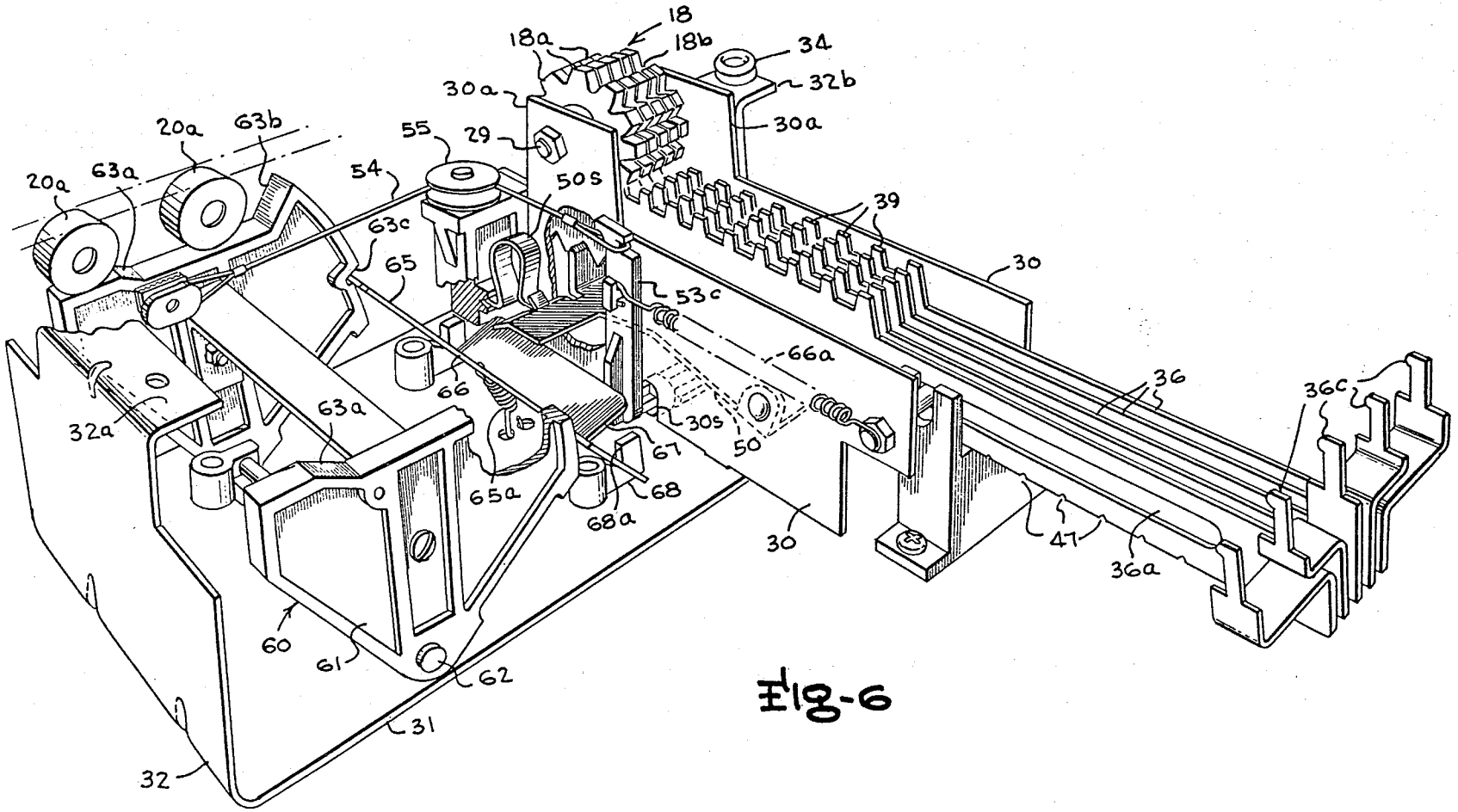
FIG. 6 is a perspective view of the interior mechanical components.

The cable 54 extends from the extension or upright lever arm 53*c* of the bell crank 53 outwardly about the cable pulley 55 journaled on a mount adjacent one of the side plates 30 and continues toward the parked or normal end position of the carrier to a location under the parked location for the carrier where it is anchored to a pivotally supported quadrant member 60. The quadrant member 60 comprises a pair of quadrant sides 61 pivotally supported near their lower ends by pivot pin 62 extending through bearings 62*a* fixed to the main chassis 32 and have shaped upper wall portions defining shouldered ramps 63*a* and 63*b* coactive with the carriage rollers 20*a* and side latch shoulders 63*c* facing the side assembly plate 30 to coact with a pivoted blocking plate 65. The bell crank 53 is continuously urged by spring 66*a* to its upright position (solid line position of FIG. 6) raising the centering blade member 50 into rack centering position inserting the blade 52 into the rack notches 40*a* but is drawn to a lowered (broken line of FIG. 3) position when the carriage 20 returns to its parked position by engagement of the carriage wheels 20*a* engaging the shoulder ramp formations 63*a* of the quadrant member 60 at that parked position.

Figure 4:
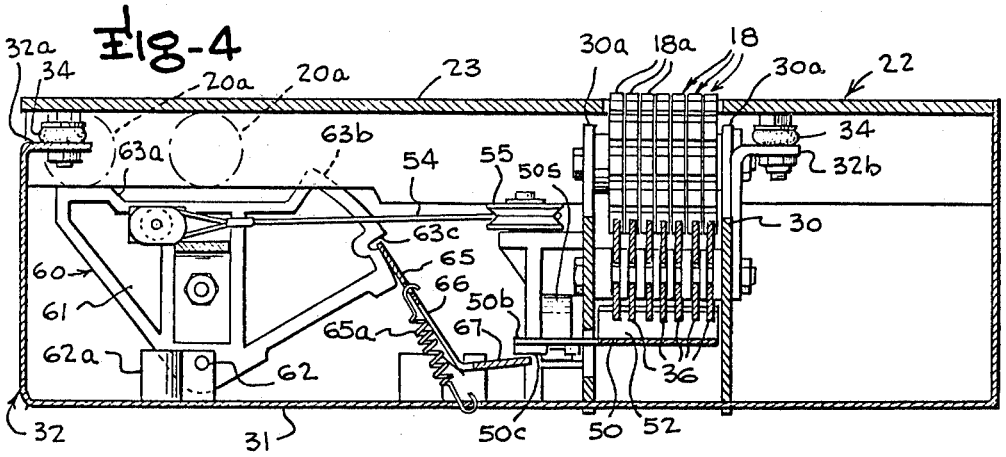
FIGS. 4 and 5 are vertical sectional views parallel to the carriage movement axis, taken along lines 4—4 and 5—5 of FIGS. 2 and 3.
Figure 5:
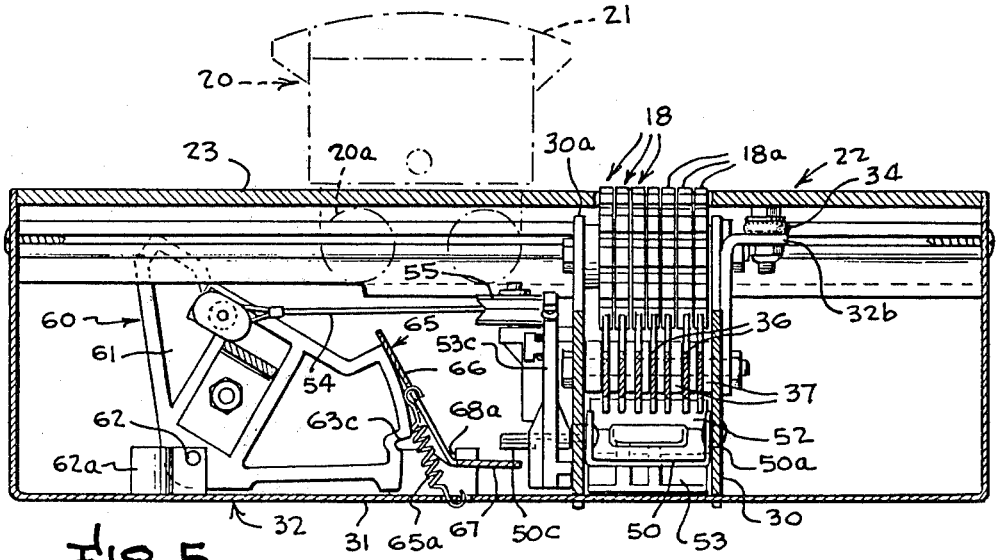

The blocking plate 65, which coacts with the quadrant member 60 to latch carriage 20 in parked position at the end of an imprinting cycle and release the carriage when a rack is reset, is an angulated plate having a first generally rectangular plate-like leg 66 and a second plate-like leg 67 extending at an acute angular relation to the plate 66, with the portions of the plate 66 extending beyond the plate 67 engaged in a V-notch 68*a* in blocking plate supporting posts 68 fixed to the bottom 31 of the main chassis 32 adjacent the same side assembly plate 30 along which the spring 66*a* and the upright arm 53*c* of the bell crank member extend. The free upper edge of the plate-like leg 66 of the blocking plate 65 coacts with the shoulder formations 63*c* of the sides 61 of quadrant member 60 to latch the quadrant member 60 in a position restraining the carriage 20 in its locked position when the blocking plate leg 66 is engaged with the shoulder formations 63*c*. The other plate-like leg 67 of the blocking plate 65 underlies the laterally projecting rigid extension 50*b* of the centering blade member 50 which projects outwardly beyond the side assembly plate 30 nearest the spring 66*a* and bell crank lever arm 53*c*, and the extension 50*b* includes a downturned inclined edge portion 50*c* to abut against the blocking plate leg 67 or be spaced very close to the blocking plate leg 67 when the centering blade 52 is fully inserted into the V-notches 40*a* of the racks 36. This inclined edge 50*c* of the extension 50*b* of centering blade plate 50 is arranged so that downward pivotal movement of the centering blade plate 50 caused by readjustment of any of the racks 36 and interaction of the inclined sides of the V-notches 40*a* thereof with the centering blade 52 upon readjustment of any rack 36 after an imprinting cycle brings the edge 50*c* downwardly against the blocking plate leg 67 causing it to tilt in a clockwise direction, as viewed in FIGS. 4 and 5, from its latching position engaging the quadrant member latch shoulder 63c to swing the blocking plate 65 out of blocking relation with the latching shoulder 63c and thereupon condition the quadrant member 60 to freely tilt in a clockwise direction from its FIG. 4 position responsive to engagement of the left-most wheels 20a of the carriage 20 with the shouldered ramps 63a at the beginning of movement of the carriage from its parked position.

The quadrant member 60 is normally retained in its carriage locking position by engagement of the blocking plate leg 66 against the latch shoulder 63c of the quadrant member. The arrangement is such that when the centering blade plate 50 is in the up or raised position, the angled extension 50c of the extension 50b of centering blade plate 50 is raised so that the blocking plate 64 occupies the solid line position shown in FIG. 4, to which it is resiliently biased by the spring 65a disposing the blocking plate in quadrant and carrier locking position. When, however, any of the racks 36 are repositioned by movement of their associated knob 44, the centering blade plate 50 is cammed downwardly by the interaction of the inclined walls of the V-shaped grooves 40a of the racks on the centering blade 52, whereby blocking plate 65 is rotated by extension arm 50b clockwise from the solid line position shown in FIG. 4, thereby releasing the blocking plate leg 66 from latch shoulder 63c and releasing quadrant 60 to allow movement of the carriage 20 from parked position.

It will be appreciated that the cable control lever 54 will be retracted in a direction pulling the bell crank lever arm 53c against the bias of its associated spring 66a, when the carrier 20 completes its return stroke and reaches the parked location because of the engagement of the carriage wheels 20a with the shoulder ramps 63a of quadrant member 60 and draws the bell crank 53 to its lowered position wherein it no longer sustains the blade plate 50 at its raised position. However, the blade plate 50 remains at this raised position by reason of the overcenter spring 50s having one end seated in the V-notch formed by inclined edge 50c and upwardly inclined tap 50d on blade plate 50 and its other end in stationary V-notch 32v. The spring 50s holds the blade plate 50 in its raised position after it is lifted to this position by raising of the bell crank 53, until such time as one of the racks 40 is readjusted causing the centering blade 52 to be cammed downwardly out of the V-groove 40a of the rack which it occupied. This action shifts the overcenter spring 50s and also the spring biased blocking plate 65 to a release position relative to the latch shoulders 63c of the quadrant member 63 allowing a new cycle of imprinting movement of the carriage 20 from parked position.

The interaction of these components is such that, when the carrier 20 is in its parked position after an imprinting and return stroke, but no rack 40 has been moved or readjusted from the position to which it was adjusted for the preceding operating cycle, the carriage 20 is locked by the quadrant member 60 which is held by blocking plate 64 in carriage locking position until one of the racks 40 is readjusted. The centering blade 52 is then cammed downwardly by the inclined wall of the rack V-notch 40a in which it was seated, causing the blade plate 50 to descend to its lower or broken line position, and thereby moving the blocking plate 60 to the carriage release position.

When the carriage 20 is moved through the initial portion of its print stroke, the cable 52 which was held in its retracted position by the quadrant member 60 and carriage 20, is released and swings under the force of the spring 66a, rotating the bell crank lever 53c in a direction to lift the bell crank 53 to its raised position. This raising of the bell crank 53 in turn lifts the centering blade plate 50 to its raised position and inserts the centering blade 52 snugly into the downwardly facing V-shaped centering notches 40a of the racks 36 most nearly aligned therewith to center the racks and thus appropriately center the amount print wheels 18. The overcenter spring 50s then resiliently retains the carriage plate 50 in its raised position until carriage 20 returns to the parked position. When the carriage 20 returns to its parked position, the quadrant member 60 is again displaced by engagement of the wheels 20a of carriage 20 against the shoulder ramps 63c to assume a displaced position causing the cable 54 to move in a direction rotating the bell crank 53 to its lowered position, although the centering blade 52 and its carrier plate 50 remain in the up or raised position due to the spring 50s and blocking plate leg 67. Then, when one of the racks 36 is readjusted, the camming action of the inclined walls of the rack centering groove 40a in which the centering blade had been seated displaces the centering blade plate 50 downwardly to its lower position, causing the extension 50b to engage and swing the blocking plate 65 to release position releasing the quadrant member 60 and carriage 20 for another imprinting cycle.

I claim:

1. A variable data imprinting machine comprising an elongated flat printing bed section providing a document supporting surface and including a print wheel pack adjacent said surface formed of rotatable, coaxial side-by-side closely adjacent print wheels each having circumferentially spaced raised-number-bearing imprint block formations separated by notches about their peripheries for imparting impressions to a document on said surface, an imprinting carriage movable from a parking position at one end of said surface through advance and return strokes longitudinally along the document support surface having a roller platen for transfer of imprinted characters to the document during one of said strokes, an elongated rack housing portion underlying and extending beyond the printing bed section defining a rack adjustment control panel projecting from a side of the printing bed section, a plurality of toothed racks slidable longitudinally in said rack housing portion with teeth of each of the racks engaging notches of the respective print wheels to rotatably index the print wheels to selected number-printing positions, means slidably supporting and guiding the toothed racks for longitudinal wheel-indexing movement subjacent the print wheels of the wheel pack, said racks having downwardly facing centering notches along their lower edges in predetermined positional relationship to said teeth, a rack centering mechanism including a blade member underlying the racks having a blade movable into and out of said notches and lifting means for raising said blade member and a control leg, a pivoted quadarant member of generally sector-shaped elevational profile located subjacent said parking position and pivoted adjacent the lowermost portion thereof about a pivot axis located below the plane of said supporting surface, said quadrant member having generally arcuate convex peripheral surface portions movable circumferentially of said pivot axis adjoining shoulder formations defining an intercept surface in the path of advancing movement of said carriage from the parked position and a stop shoulder engageable with said control leg to latch the quadarant member in a blocking position restraining the carriage in said parking position, means moving the control leg from latching abutment with said stop shoulder responsive to adjustment of the toothed racks to new settings, and means positioned to be activated by movement of said carriage during a pre-imprinting part of its advance stroke to insert said blade into said centering notches of each rack for precisely aligning the print wheels to insure proper fine adjustment registration of the imprinting numbers at the printing positions.

2. A variable data imprinting machine as defined in claim 1, wherein said control panel includes an upwardly facing top wall having rectilinear parallel slots extending substantially the length thereof paralleling and corresponding in number to the racks, said toothed racks have upwardly projecting end formations extending through said slots having knobs thereon disposed at accessible positions overlying the control panel for manual adjustment thereof to number-setting positions, and said slots being disposed sufficiently wide apart for non-interfering manipulation of the respective knobs.

3. A variable data imprinting machine as defined in claim 2, wherein said panel includes a sight opening adjacent an end of each of the control panel slots, a plurality of number bearing rigid slide strips connected respectively to the rack end formations and supported in slideways beneath said top wall for rectilinear movement paralleling said slots to register their numbers with each sight openings signifying the positions for the knobs to achieve coarse adjustment location of corresponding print wheel numbers at the printing positions, the racks having detent notches for the number setting positions of said knobs, and spring-biased detent means engageable in said detent notches for releasably restraining the racks at the number setting positions.

4. A variable data imprinting machine as defined in claim 3, wherein said centering notches of said racks are downwardly divergent substantially V-shaped notches in the lower edges of the racks in predetermined positional relationship to said teeth, and said blade member is a lever pivoted about a horizontal pivot axis having said blade on an end thereof insertable into said centering notches of each rack to fine adjust the racks to insure proper fine adjustment registration of the imprinting numbers at the printing positions.

5. A variable data imprinting machine as defined in claim 2, wherein said centering notches of said racks are downwardly divergent substantially V-shaped notches in the lower edges of the racks in predetermined positional relationship to said teeth, and said blade member is a lever pivoted about a horizontal pivot axis having said blade on an end thereof insertable into said centering notches of each rack to fine adjust the racks to insure proper fine adjustment registration of the imprinting numbers at the printing positions.

6. A variable data imprinting machine as defined in claim 5, wherein said quadrant member has abutment surfaces in the path of movement of portions of the carriage to assume blocking and release positions responsive to carriage movement, means urging said lifting means to a position raising said blade into fine adjustment centering insertion into the notches, and flexible linking means interconnecting said sensing member and lifting means to raise the blade into said notches when the carriage sensing member is moved to its release position upon movement of the carriage through said pre-imprinting part of its advance stroke and for withdrawing lifting force from said blade when the carriage nears its parking position at completion of its return stroke.

7. A variable data imprinting machine as defined in claim 2, wherein said quadrant member has abutment surfaces in the path of movement of portions of the carriage to assume blocking and release positions responsive to carriage movement, means urging said lifting means to a position raising said blade into fine adjustment centering insertion into the notches, and flexible linking means interconnecting said sensing member and lifting means to raise the blade into said notches when the carriage sensing member is moved to its release position upon movement of the carriage through said pre-imprinting part of its advance stroke and for withdrawing lifting force from said blade when the carriage nears its parking position at completion of its return stroke.

8. A variable data imprinting machine as defined in claim 1, wherein said centering notches of said racks are downwardly divergent substantially V-shaped notches in the lower edges of the racks in predetermined positional relationship to said teeth, and said blade member is a lever pivoted about a horizontal pivot axis having said blade on an end thereof insertable into said centering notches of each rack to fine adjust the racks to insure proper fine adjustment registration of the imprinting numbers at the printing positions.

9. A variable data imprinting machine as defined in claim 8, wherein said quadrant member has abutment surfaces in the path of movement of portions of the carriage to assume blocking and release positions responsive to carriage movement, means urging said lifting means to a position raising said blade into fine adjustment centering insertion into the notches, and flexible linking means interconnecting said sensing member and lifting means to raise the blade into said notches when the carriage sensing member is moved to its release position upon movement of the carriage through said pre-imprinting part of its advance stroke and for withdrawing lifting force from said blade when the carriage nears its parking position at completion of its return stroke.

10. A variable data imprinting machine as defined in claim 1, wherein said quadrant member has abutment surfaces in the path of movement of portions of the carriage to assume blocking and release positions responsive to carriage movement, means urging said lifting means to a position raising said blade into fine adjustment centering insertion into the notches, and flexible linking means interconnecting said sensing member and lifting means to raise the blade into said notches when the carriage sensing member is moved to its release position upon movement of the carriage through said pre-imprinting part of its advance stroke and for withdrawing lifting force from said blade when the carriage nears its parking position at completion of its return stroke.

* * * * *